US009435046B2

(12) United States Patent
Zhang-Beglinger et al.

(10) Patent No.: US 9,435,046 B2
(45) Date of Patent: Sep. 6, 2016

(54) HIGH SPEED METHOD FOR PLATING PALLADIUM AND PALLADIUM ALLOYS

(71) Applicant: Rohm and Haas Electronic Materials LLC, Marlborough, MA (US)

(72) Inventors: Wan Zhang-Beglinger, Adligenswil (CH); Margit Clauss, Kriens (CH); Jonas Guebey, Kriens (CH); Felix J. Schwager, Meggen (CH)

(73) Assignee: Rohm and Haas Electronics LLC

( * ) Notice: Subject to any disclaimer, the term of this patent is extended or adjusted under 35 U.S.C. 154(b) by 370 days.

(21) Appl. No.: 13/924,553

(22) Filed: Jun. 22, 2013

(65) Prior Publication Data

US 2013/0284605 A1 Oct. 31, 2013

Related U.S. Application Data

(60) Division of application No. 12/912,400, filed on Oct. 26, 2010, now abandoned, which is a continuation-in-part of application No. 12/220,037, filed on Jul. 21, 2008, now abandoned.

(60) Provisional application No. 60/961,393, filed on Jul. 20, 2007.

(51) Int. Cl.
*C25D 3/56* (2006.01)
*C25D 3/52* (2006.01)

(52) U.S. Cl.
CPC ..... *C25D 3/567* (2013.01); *C25D 3/52* (2013.01); *C25D 3/56* (2013.01)

(58) Field of Classification Search
CPC ..... C25D 3/56; C25D 3/562; C25D 3/567
USPC ..... 205/255, 257, 238, 244, 245, 246, 259
See application file for complete search history.

(56) References Cited

U.S. PATENT DOCUMENTS

| | | | | | |
|---|---|---|---|---|---|
| 2,817,628 | A | * | 12/1957 | Breining et al. | 205/315 |
| 3,458,409 | A | | 7/1969 | Hayashi et al. | |
| 3,580,820 | A | | 5/1971 | Yamamura et al. | |
| 3,637,474 | A | | 1/1972 | Zuntini et al. | |
| 3,677,909 | A | | 7/1972 | Yamamura et al. | |
| 3,920,526 | A | | 11/1975 | Caricchio et al. | |
| 3,925,170 | A | | 12/1975 | Skomoroski et al. | |
| 3,933,602 | A | * | 1/1976 | Henzi | C25D 3/567 205/257 |
| 4,066,517 | A | | 1/1978 | Stevens et al. | |
| 4,076,599 | A | | 2/1978 | Caricchio, Jr. et al. | |
| 4,092,225 | A | | 5/1978 | Davis | |
| 4,098,656 | A | | 7/1978 | Deuber | |
| 4,100,039 | A | | 7/1978 | Caricchio, Jr. et al. | |
| 4,224,115 | A | | 9/1980 | Nara et al. | |
| 4,242,180 | A | | 12/1980 | Heppner et al. | |
| 4,297,177 | A | | 10/1981 | Fletcher et al. | |
| 4,316,779 | A | | 2/1982 | Yahalom | |
| 4,428,802 | A | | 1/1984 | Kanai et al. | |
| 4,454,010 | A | | 6/1984 | Trop | |
| 4,545,868 | A | | 10/1985 | Martin et al. | |
| 4,545,869 | A | | 10/1985 | Goldman | |
| 4,552,628 | A | | 11/1985 | Wilcox et al. | |
| 4,564,426 | A | | 1/1986 | Henning et al. | |
| 4,622,110 | A | | 11/1986 | Martin et al. | |
| 4,673,472 | A | | 6/1987 | Morrissey et al. | |
| 4,715,935 | A | | 12/1987 | Lovie et al. | |
| 4,849,303 | A | | 7/1989 | Graham et al. | |
| 4,911,798 | A | | 3/1990 | Abys et al. | |
| 4,911,799 | A | * | 3/1990 | Abys | C25D 3/52 205/257 |
| 5,342,504 | A | | 8/1994 | Hirano et al. | |
| 5,415,685 | A | | 5/1995 | Paneccasio, Jr. et al. | |
| 5,750,016 | A | | 5/1998 | Moon | |
| 5,976,344 | A | | 11/1999 | Abys et al. | |
| 6,409,906 | B1 | * | 6/2002 | Aoun | 205/239 |
| 2002/0144909 | A1 | | 10/2002 | Ueki | |
| 2005/0126427 | A1 | * | 6/2005 | Gonzalez et al. | 106/1.16 |

FOREIGN PATENT DOCUMENTS

| | | | | | |
|---|---|---|---|---|---|
| EP | 0107308 | | | 5/1984 | |
| EP | 0 619386 | | | 10/1994 | |
| GB | 1171734 | | | 11/1969 | |
| GB | 2283498 | | | 5/1995 | |
| JP | 4-365877 | | | 12/1992 | |
| JP | 07011475 | A | | 1/1995 | |
| JP | 07011475 | A | * | 1/1995 | C25D 3/50 |
| JP | 2001181887 | A | | 7/2001 | |
| RU | 254988 | | | 4/1970 | |
| RU | 263354 | | | 5/1970 | |
| RU | 452626 | | | 4/1975 | |
| RU | 572539 | | | 9/1977 | |
| SU | 572539 | A | * | 9/1977 | C25D 3/50 |
| WO | WO 86/00652 | | | 1/1986 | |

OTHER PUBLICATIONS

Appleton et al.; "Amino acid complexes of palladium(II). 1. NMR study of the reactions of the diaqua(ethylenediamine)palladium(II) cation with ammonia, betaine, and the amino acids $^{+}NH_3(CH_2),CO_2$-(n=1-3)[1]"; Inorg. Chem. 1994, 33, pp. 217-226.

Micklitz et al.; "Dinuclear (Pt,Pt) and heteronuclear (Pt,Pd) complexes of uracil nucleobases with identical and mixed amine ($NH_3$, en, bpy) ligands on the two metals. Effects of the heterometal and amine on the oxidizability"; Inorganic Chemistry, vol. 27, No. 11, 1988; pp. 1979-1986.

Shevchenko et al.; "Introducing a tritium label at methyl and methylene positions of polyamines and sodium acetate by solid-phase isotope exchange"; Radiochemistry, vol. 36, No. 5, 1994; pp. 440-444.

* cited by examiner

*Primary Examiner* — Edna Wong
(74) *Attorney, Agent, or Firm* — John J. Piskorski

(57) ABSTRACT

A high speed method of depositing palladium and palladium alloys is disclosed. The high speed method uses an aqueous, ammonia-based bath which has reduced free ammonia in the bath. The high speed method may be used to deposit palladium and palladium alloy coatings on various substrates such as electrical devices and jewelry.

2 Claims, No Drawings

HIGH SPEED METHOD FOR PLATING PALLADIUM AND PALLADIUM ALLOYS

The present application is a Divisional of U.S. Non-Provisional Application Ser. No. 12/912,400, filed Oct. 26, 2010, now abandoned, which application is a Continuation-in-Part application of Non-Provisional application Ser. No. 12/220,037, filed Jul. 21, 2008, now abandoned, which application claimed benefit of U.S. Provisional Application No. 60/961,393, filed Jul. 20, 2007.

The present invention is directed to high speed methods for plating palladium and palladium alloys using ammonia-based palladium and palladium alloy plating compositions. More specifically, the present invention is directed to high speed methods for plating palladium and palladium alloys using ammonia-based palladium and palladium alloy plating compositions where the level of free ammonia is reduced.

The dramatic increase in the price of gold over the past several years has given rise to new methods and equipment in the metal plating field and attempts to use substitute metals such as palladium and its alloys through, for example, reel-to-reel plating. The use of such plating processes requires high speed plating and high speed requires current densities of 10 Amps/dm$^2$ and above. In addition, the industry desires high speed plating to achieve metal deposition in as short a time as possible to be more efficient in the manufacturing of metal plated articles. High speed plating equipment may employ the jet plating principle where the plating solution is sprayed out onto a substrate being plated with a jet stream to provide vigorous agitation. Vigorous agitation may also be supplied without the jet stream by moving the solution very rapidly past the substrate being plated by use of a pump or by moving the substrate rapidly through the solution. Another form of high speed plating is selective plating. Such selective plating uses specialized plating equipment such as chemical or mechanical masks which limit metal deposits to specific required areas while leaving other areas free of the metal.

Attempts have been made to plate palladium and its alloys from high speed plating equipment with various baths; however, the deposits are either burned or matte gray or they are bright to semi-bright and highly stressed and exhibit surface micro-cracks which are visible only under a microscope at high power. Such cracks can be visible in the deposit right out of the plating bath or they become visible later after the deposit has been permitted to stand at room temperature for a day or more. There is a large amount of literature about the cracks. It is attributed to the co-deposition of hydrogen or carbon from organic components with palladium. The industry desires palladium and palladium alloy deposits that are crack-free at usable current densities in high speed plating from 10 to 100 Amps/dm$^2$ and higher. In addition the industry desires palladium and palladium alloys which have high wear resistance, high corrosion resistance, low electrical resistance and good solderability, such as for use as coatings for electrical contacts.

To achieve a palladium or palladium alloy deposit from a plating process with the desired properties, a number of process parameters must be addressed. Such parameters include, but are not limited to, the composition of the bath, bath temperature, agitation rate during plating and bath pH. The specific parameters to achieve an optimum process may vary widely depending on whether the process is for low speed or high speed plating. Many palladium and palladium alloy plating processes use ammonia as a ligand for metals Ammonia based processes have many advantages over ammonia free processes. Such advantages include: 1) no detrimental decomposition products from organic ligands in contrast to other types of ligands, such as polyamine type ligands, which may co-deposit with palladium; 2) highly ductile deposits; and 3) palladium-ammonia salts are more economical and readily available than many exotic palladium salts which are required for ammonia free processes.

Such ammonia-based processes operate from the neutral to high alkaline pH range, such as from a pH of 7 and higher. During bath operation free ammonia escapes from the baths as ammonia vapor. This alters the pH of the bath and destabilizes it to seriously compromise the bath performance. This is especially problematic at high speed plating where plating rates are faster and bath agitation is more vigorous than with low speed plating, thus causing a greater rate of free ammonia loss. Also, plating at high temperatures or an increase in temperature during plating, which is typical for high speed plating, causes ammonia loss from the bath, thus destabilizing the plating process. Ammonia-based plating processes require frequent replacement of ammonia to maintain the stability and optimum operation of the process. However, ammonia replenishment is difficult. Ammonia is often replenished by adding ammonium salts, e.g. ammonium sulfate for sulfate-based solutions, to the plating bath; however, this results in an accumulation of anions in the plating bath which dramatically reduces the life of the bath due to salting out of bath components Ammonia gas and ammonium hydroxide also may be added to the baths; however, such compounds are inconvenient and problematic to handle. Both present potential serious noxious and toxic hazards to workers using them. Typically, adding ammonium compounds to the bath to maintain pH at high speed plating rates results in undesirable levels of free ammonia of 100 to 150 g/L. The odor of ammonia at such levels becomes intolerable for workers. The more free ammonia added to the bath the greater the ammonia loss, thus presenting a hazard to the environment. Using alkaline agents, such as NaOH to maintain pH in a conventional ammonia-based plating bath quickly leads to low levels of free ammonia but causes stability problems. Although amides and amines have been used to replace ammonia, reaction products of such compounds have been found to accumulate in aged baths causing increased internal stress and decrease in palladium metal deposit ductility. Accordingly, the industry desires a high speed plating method where the free ammonia level is reduced.

At high speed plating, such as reel-to-reel plating, ammonia loss is greater, thus requiring a greater rate of ammonia replacement and increasing the difficulty of maintaining a stable plating process. Also, the high temperatures and rapid agitation of the bath during high speed plating further increase the loss of ammonia and destabilize the bath. A rapid loss of ammonia results in an unstable bath and poor process performance This reduces the overall efficiency of the process and increases the cost of plating.

U.S. Pat. No. 5,415,685 discloses an ammonia-based palladium plating composition and process. The patent alleges that the ammonia-based palladium plating composition is both stable and provides a whiter palladium deposit over a wider range of plating thicknesses than conventional processes. The process described in the patent is a low speed process with current densities ranging from 0.1 Amps/ft$^2$ to 50 Amps/ft$^2$ (0.01 Amps/dm$^2$ to 5 Amps/dm$^2$). Such processes are not suitable in an industry where high speed plating is mandatory to achieve economic efficiency. Accordingly, there is a need for a high speed method for plating palladium and palladium alloys from an ammonia-based bath.

In one aspect a method includes: a) providing a composition including one or more sources of palladium ions, ammonium ions and at least 55 g/L urea; b) contacting a substrate with the composition; and c) generating a current density of at least 10 Amps/dm$^2$ to deposit palladium on the substrate.

In another aspect a method includes: a) providing a composition comprising one or more sources of palladium ions, one or more sources of alloying metals, ammonium ions and at least 55 g/L urea; b) contacting a substrate with the composition; and c) generating a current density of at least 10 Amps/dm$^2$ to deposit a palladium alloy on the substrate.

The high speed methods provide stable palladium and palladium alloy baths and eliminate the need to add ammonium sulfates, ammonium hydroxide, ammonia gas or other ammonium compounds to replenish the free ammonia levels in the bath. Thus, the hazards and other disadvantages of adding such compounds to the plating baths are eliminated. The high speed methods also reduce the amount of free ammonia in the bath in contrast to many conventional high speed palladium and palladium alloy processes. Sufficient urea is included in the baths such that the amount of free ammonia is maintained at levels of less than 50 g/L throughout the life of the bath. Accordingly, the vapor level of ammonia is reduced.

The high speed methods provide bright, ductile and crack free palladium and palladium alloy deposits on substrates at high current densities. The high speed methods may be used to plate palladium and palladium alloys on any substrate where palladium and palladium alloy coatings are desired. Such substrates include electronic components as well as jewelry. Electronic components may include electrical contacts where high wear resistance, high corrosion resistance and low electrical contact resistance and good solderability are desired.

As used throughout the specification, the following abbreviations have the following meaning unless the context clearly indicates otherwise: ° C.=degrees Centigrade; g=gram; mg=milligrams; L=liter; mL=milliliter; Amps=amperes; dm=decimeter; μm=microns=micrometer; and rpm=revolutions per minute.

The terms "depositing", "plating" and "electroplating" are used interchangeably throughout this specification. The term "burnt" means a dull or coarse finish. The term "bright" means an optical reflective finish. The term "ductile" or "ductility" is the resistance of metal deposits to cracking during distortion, such as bending or stretching. "Metal turnover (MTO)"=total palladium deposited in grams divided by the palladium content in the solution in grams. All amounts are percent by weight unless otherwise noted. All numerical ranges are inclusive and combinable in any order except where it is logical that such numerical ranges are constrained to add up to 100%.

The methods are high speed electroplating methods for depositing palladium and palladium alloys with low levels of free ammonia, thus reducing the generation of ammonia vapor during high speed electroplating and vigorous bath agitation. Typically, the free ammonia in the electroplating baths does not exceed 50 g/L throughout of the bath life, preferably the free ammonia is 15 g/L and less, more preferably the free ammonia is 10-15 g/L. Typically the bath life is at least 10 MTO, more typically 10-50 MTO, most typically 10-20 MTO. The reduction in free ammonia also provides for a more environmentally friendly bath since less ammonia vapor is generated during electroplating in contrast to many conventional ammonia-based baths. The unpleasant and annoying odor of ammonia is eliminated or at least reduced. Also, constantly evaporating ammonia causes considerable difficulties in controlling the pH value. In conventional ammonia-based baths ammonia is continuously added in metered quantities to maintain an optimum pH. Typically, ammonium sulfate, ammonium hydroxide and ammonia gas are used. Such compounds are difficult to handle are noxious and are hazardous to workers. Further, adding such compounds to the baths often cause the salting out of bath components, thus compromising bath performance. The high speed methods eliminate the need to add such compounds to the plating baths.

Urea is included in the baths in amount of at least 55 g/L, or such as from 55 g/L to 200 g/L, preferably from 80 g/L to 200 g/L, more preferably in amounts of 80 g/L to 150 g/L, to stabilize the baths by compensating for the reduced free ammonia and for preventing changes in the pH due to the loss of ammonia by forming palladium complexes or by generating free ammonia in solution from urea hydrolysis. The high speed electroplating baths have a pH range of 6 to 10, preferably, from 7 to 8. Including urea in the baths eliminates the need to replenish ammonia by the addition of ammonium compounds or ammonia. Urea is easier to handle than ammonia or ammonium compounds. Urea is a weak complexing agent and addition of large quantities of urea to ammonia-based plating baths does not detrimentally affect the microstructure of palladium and palladium alloy deposits. Further, there is no accumulation of decomposition products which limit the bath life. Additionally, one of the hydrolysis products of urea is ammonia and this ammonia is used to replenish the loss of free-ammonia and help maintain the desired pH and the bath stability. The anodic reaction of urea at a pH of 7 to 8 produces nitrogen, carbon dioxide and water.

The alkali metal hydroxides and the metal carbonates may be used to adjust the pH to a desired level to avoid using ammonia. Sufficient amounts are included in the bath to help maintain a desired pH and free ammonia concentration.

A wide variety of palladium compounds may be used as a source of palladium ions in the high speed electroplating methods provided that they are compatible with the high speed process and other bath components. Such palladium compounds include, but are not limited to, palladium complex ion compounds with ammonia as the complexing agent. Such compounds include, but are not limited to, dichlorodiammine palladium (II), dinitrodiammine palladium (II), tetrammine palladium (II) chloride, tetrammine palladium (II) sulfate, tetrammine palladium tetrachloropalladate, tetramine palladium carbonate and tetramine palladium hydrogen carbonate. Additional sources of palladium include, but are not limited to, palladium dichloride, palladium dibromide, palladium sulfate, palladium nitrate, palladium monoxide-hydrate, palladium acetates, palladium propionates, palladium oxalates and palladium formates. One or more sources of palladium ions may be mixed together in the bath. Typically, the ammonia palladium complexes are used in the bath. Sufficient amounts of one or more sources of palladium ions are added to the bath to provide 10 g/L to 50 g/L of palladium ions for deposition, or such as from 20 g/L to 40 g/L of palladium ions.

Ammonia may be initially added to the bath by water soluble ammonium salts. Such ammonium salts include, but are not limited to, ammonium halides, such as ammonium chloride and ammonium bromides, ammonium sulfates and ammonium nitrates. Sources of ammonia are added to the baths in sufficient amounts to provide free ammonia in amounts of less than 50 g/L, or such as from 10 g/L to 45 g/L, or such as from 15 g/L to 35 g/L.

Alloying metal ions which may be added to the high speed electroplating baths to form palladium alloys include, but are not limited to, one or more sources of nickel, cobalt, iron, silver and zinc ions. The alloys may be binary alloys or ternary alloys. Typically, the alloys are binary alloys such as palladium/nickel, palladium/cobalt, palladium/silver and palladium/zinc. Preferably the binary alloy is palladium/nickel. Typically, the ternary alloy is palladium/nickel/zinc. One or more sources of alloying metal ions may be added to the baths as a water soluble salt. Such salts include, but are not limited to, halides, sulfates, sulfites, phosphates, pyrophosphates, nitrates, oxides and salts with organic acids, such as acetates, propionates, oxalates and formates. Typically, the halide and sulfate salts are used. Sufficient amounts of one or more alloying metal salts are added to the baths to provide alloying metal ions in amounts of 0.1 g/L to 15 g/L, or such as from 1 g/L to 10 g/L.

Palladium alloys made by the high speed methods are stable. Stability means that the alloy composition remains substantially constant over a wide current density range as well as changes in the pH of the bath, temperature fluctuations and bath agitation rates. The weight ranges of palladium in the binary alloys range from 50 wt % to 90 wt % with the balance being the alloying metal. An example of such a binary alloy which is used for coatings on electrical contacts is palladium/nickel (80 wt %/20 wt %). The weight ranges of palladium in a ternary alloy range from 40 wt % to 80 wt % with the balance being the two alloying metals in equal or unequal proportions.

The palladium electroplating baths used in the high speed methods include one or more sources of palladium ions, ammonium ions and at least 55 g/L urea, preferably from 80 g/L to 200 g/L, more preferably from 80 g/L to 150 g/L. When the bath is used for depositing a palladium alloy, one or more alloying metal ions are added to the bath. The palladium and palladium alloys deposited by the high speed methods are bright, crack free and adhere to substrates. They also have low tensile stress which is equal to high ductility. Ductility is typically tested by bending the deposit. No cracks found on the deposit at higher bending degrees such as 90-180° means high ductility.

One or more conventional additives also may be added to the bath. Such conventional additives include, but are not limited to, buffers, brighteners, surfactants and mixtures thereof. Such additives may be included in the bath in conventional amounts.

One or more surfactants which do not compromise the performance of the bath may be included. Typically, such surfactants include, but are not limited to, non-ionic surfactants, cationic surfactants and anionic surfactants. Examples of such surfactants are polyethylene glycols, alkyl quaternary ammonium salts and sulfopropylated alkylalkoxylates.

Optional buffering agents include, but are not limited to, one or more of mineral acids, such as sulfuric acid, hydrochloric acid and nitric acid, acetic acid, boric acid, carbonic acid, citric acid, tetraboric acid, maleic acid, itaconic acid and salts thereof. Other conventional water soluble acids also may be included as buffering agents.

Suitable brighteners are those compounds which provide a bright palladium or palladium alloy deposit. Such brighteners include conventional organic brighteners. Such organic brighteners include, but are not limited to, succinimide, maleimide, quinolines, substituted quinolines, phenanthrolines and substituted phenanthrolines and quaternized derivatives thereof, pyridine and its derivatives, such as pyridine carboxylic acids, pyridine carboxylic acid amines, and polypyridines, such as bipyridines, nicotinic acid and its derivatives, pyridinium alkyl sulfobetaine, piperidine and its derivatives, piperazine and its derivatives, pyrazine and its derivatives and mixtures thereof. Typically, the brighteners used in the high speed baths are organic brighteners which have nitrogen containing heterocyclic rings, however, excluding aromatic sulfonamides. More typically, the brighteners used are pyridine derivatives, pyrazine derivatives or mixtures thereof.

Since the palladium and palladium alloys deposited by the high speed methods are typically crack free, stress reducing agents are, in general, excluded from the baths. An example of such stress reducing agents are the aromatic sulfonamides. A typical aromatic sulfonamide which is used as a stress reducing agent is saccharin.

Bath temperatures may be maintained by conventional heating apparatus. Bath temperatures range from 40 to 70° C., or such as from 50 to 60° C. Maintaining the bath temperature within the ranges, in particular at the higher end of the range, is highly desirable because as the temperature increases the amount of ammonia vapor leaving the bath also increases. Accordingly, temperature maintenance is important.

The high speed electroplating methods use current densities from 10 Amps/dm$^2$ and higher. Typically, current densities range from 10 Amps/dm$^2$ to 100 Amps/dm$^2$, or such as from 20 Amps/dm$^2$ to 80 Amps/dm$^2$. Such current densities are controlled using conventional rectifiers.

Conventional high speed plating apparatus may be used to electroplate palladium metal and palladium metal alloys. Typically, the palladium and palladium alloys are electroplated using reel-to-reel plating apparatus; however, any apparatus which maintains a high speed plating rate may be used.

Conventional insoluble anodes may be used with the high speed methods. Examples of insoluble anodes include, but are not limited to, platinized titanium, mixed oxide coated titanium and stainless steel. Also, anodes with the above mentioned materials with the shield design as described in US 2006/0124451 may be used.

Cathodes include any substrate which may be plated with palladium or a palladium alloy. In general, the palladium or palladium alloy is deposited on copper, copper alloy or nickel-plated copper substrates. Such substrates may be electrical contacts where high wear resistance, high corrosion resistance, low electrical contact resistance, high ductility and good solderability are required. Examples of an electrical contact are lead frames and electrical connectors. Electronic devices which include such electrical contacts include, but are not limited to, printed circuit boards, semiconductor devices, optoelectronic devices, electrical components and automobile components. Additionally, the high speed methods may be used to deposit palladium or palladium alloys on components for solar cell devices and jewelry as well as any article which may accept a palladium or palladium alloy coating.

The thicknesses of the palladium and palladium alloy coatings deposited by the high speed methods may vary and depend on the function of the substrate. In general, thicknesses range from 0.1 μm to 100 μm. Typically, the thicknesses range from 0.2 μm to 10 μm.

The rate of deposit depends on the current density used. In general, the rate may range from 1 μm/min to 30 μm/min. For example, palladium/nickel alloy may be plated at 3 μm/min at 10 Amps/dm$^2$ and 18 μm/min at 60 Amps/dm$^2$.

The following examples are intended to further illustrate the high speed methods, but are not intended to limit the scope of the invention.

EXAMPLE 1 (COMPARATIVE)

The following conventional palladium/nickel alloy aqueous, ammonia-based composition was prepared to deposit a palladium/nickel alloy (80/20% w/w):

TABLE 1

| COMPONENT | AMOUNT (g/L) MTO = 0 | AMOUNT (g/L) MTO = 3 |
|---|---|---|
| Palladium as $Pd(NH_3)_4SO_4$ | 15 | 15 |
| Nickel as $NiSO_4$ | 6 | 6 |
| Boric acid | 26 | 26 |
| Free $NH_3$ as $(NH_4)_2SO_4$ | 35 | 110 |
| 3-pyridine carboxylic acid | 0.1 | 0.1 |
| $NH_4OH$ | Adjust pH to 7.2 | Maintain pH at 7.2 |

The initial plating bath where MTO=0 included a free ammonia concentration of 35 g/L. The electroplating was done in a reel-to-reel, high speed plating line at 15 Amps/$dm^2$. The bath temperature was maintained at 50° C. The pH was maintained at 7.2 in order to minimize the ammonia vapor loss. The anode was an insoluble platinized titanium insoluble anode. The cathode was a nickel pre-plated brass substrate. A bright, crack-free palladium/nickel alloy (80 wt %/20 wt %) was deposited on the substrate.

Free ammonia in the bath was analyzed every MTO for the first 5 MTO. The ammonia content was monitored by a pH titration method using 809 Titrando™ from Metrohm. It was observed that the free ammonia content increased with the bath age due to adjusting the pH with ammonium hydroxide. At 3 MTO, free ammonia increased from 35 g/l to 110 g/l and the odor of ammonia became increasingly noticeable with the aging of the bath.

EXAMPLE 2 (COMPARATIVE)

The following conventional palladium/nickel alloy aqueous, ammonia-based composition was prepared to deposit a palladium/nickel alloy (80/20% w/w):

TABLE 2

| COMPONENT | AMOUNT (g/L) MTO = 0 | AMOUNT (g/L) MTO = 3 |
|---|---|---|
| Palladium as $Pd(NH_3)_4SO_4$ | 15 | 15 |
| Nickel as $NiSO_4$ | 6 | 6 |
| Boric acid | 26 | 26 |
| Free $NH_3$ as $(NH_4)_2SO_4$ | 35 | 9 |
| 3-pyridine carboxylic acid | 0.1 | 0.1 |
| NaOH | Adjust pH to 7.0-7.2 | Maintain pH at 7.0-7.2 |

The initial bath had a free ammonia concentration of 35 g/L. The electroplating was done in a reel-to-reel, high speed plating line at 15 Amps/$dm^2$. The bath temperature was maintained at 50° C. The pH during plating ranged from 7-7.2 in order to minimize the ammonia vapor loss. The anode was an insoluble platinized titanium insoluble anode. The cathode was a nickel pre-plated brass substrate. A bright, crack-free palladium/nickel alloy (80 wt %/20 wt %) was deposited on the substrate.

Free ammonia in the bath was analyzed every MTO for the first 5 MTO. The ammonia content was monitored by a pH titration method using 809 Titrando™ from Metrohm It was observed that the free ammonia content decreased rapidly as the bath aged due to the pH adjustment using sodium hydroxide. At 3 MTO, free ammonia decreased from 35 g/l to 9 g/l. However, an undesired white to yellowish precipitation containing palladium was found in the plating solution. This had to be removed by filtration in order to continue plating. This conventional composition was unstable when free ammonia was reduced to levels below 35 g/L.

EXAMPLE 3

A palladium/nickel alloy electroplating bath having the formula in Table 3 was prepared for depositing a palladium/nickel alloy (80 wt %/20 wt %).

TABLE 3

| COMPONENT | AMOUNT (g/L) MTO = 0 | AMOUNT (g/L) MTO = 3 |
|---|---|---|
| Palladium as $Pd(NH_3)_4SO_4$ | 15 | 15 |
| Nickel as $NiSO_4$ | 6 | 6 |
| Boric acid | 26 | 26 |
| Free $NH_3$ as $(NH_4)_2SO_4$ | 35 | 11 |
| Urea | 100 | 100 |
| 3-pyridine carboxylic acid | 0.1 | 0.1 |
| NaOH | Adjust pH to 7.2 | Maintain pH at 7.2 |

The electroplating was done in a reel-to-reel, high speed plating line at 15 Amps/$dm^2$. The bath temperature was maintained at 50° C. The pH was kept at 7.2 in order to minimize the ammonia vapor loss. The anode was an insoluble platinized titanium insoluble anode. The cathode was a nickel pre-plated brass substrate. A bright, crack-free palladium/nickel alloy (80 wt %/20 wt %) was deposited on the substrate.

Free ammonia in the bath was analyzed every MTO for the first 5 MTO. The ammonia content was monitored by a pH titration method using 809 Titrando™ from Metrohm It was observed that the free ammonia content decreased rapidly with the bath age from the pH adjustment using sodium hydroxide. At 3 MTO, free ammonia decreased from 35 g/l to 11 g/l. The unpleasant ammonia odor during operation was hardly noticeable. Urea replenishment was 0.7 to 0.8 g/g of palladium metal deposited during plating to maintain a urea concentration of 100 g/L. No precipitation was observed throughout the bath life of greater than 10 MTO. The urea in combination with the sodium hydroxide reduced free ammonia and stabilized the palladium/nickel bath over the plating period.

EXAMPLE 4

The palladium/nickel method described in Example 3 was repeated except that the amount of urea added to the electroplating composition was 150 g/L. The rate of urea replenishment was 0.7 to 0.8 g/g of palladium metal deposited on the brass substrate to maintain a urea level of 150 g/L. The bath was stable throughout electroplating. The performance of this method was the same as in Example 3. A bright and ductile palladium/nickel alloy was deposited on the brass substrate.

EXAMPLE 5

Four bright nickel coated brass substrates were electroplated with the aqueous, ammonia-based palladium/nickel composition as described in Example 3. Each substrate was plated with the composition at different current densities. The current densities were 20 Amps/dm$^2$, 40 Amps/dm$^2$, 60 Amps/dm$^2$ and 80 Amps/dm$^2$. The pH of the plating composition was 7.2 with a temperature of 50° C. The high speed method was done using JetLab jet plating equipment designed for laboratory testing. The plating composition was applied to the substrates at a flow rate of 800 liters/hour. All of the palladium/nickel deposits on the bright nickel coated brass substrates were bright, ductile and adhered to the substrates.

EXAMPLE 6

The following aqueous, ammonia-based palladium metal composition is prepared for depositing a palladium coating on a copper substrate:

TABLE 4

| COMPONENT | AMOUNT (g/L) |
|---|---|
| Palladium as $[Pd(NH_3)_4]Cl_2$ | 10 |
| Free $NH_3$ as $(NH_4)Cl$ | 30 |
| Boric acid | 20 |
| Urea | 100 |
| 3-pyridine carboxylic acid | 0.2 |
| NaOH | Adjust pH to 7.2 |

The aqueous, ammonia-based palladium composition is deposited on the copper substrate using jet plating equipment as described in Example 5. The pH of the composition is maintained at 7.2 and the temperature of the composition is maintained at 50° C. The current density is 20 Amps/dm$^2$. The bath is expected to be stable during electroplating. The resulting palladium coatings on the substrates are expected to be bright and crack-free.

EXAMPLE 7

The following aqueous, ammonia-based palladium/cobalt alloy composition is prepared for depositing a palladium/cobalt alloy on a copper substrate:

TABLE 5

| COMPONENT | AMOUNT (g/L) |
|---|---|
| Palladium as $[Pd(NH_3)_4]Cl_2$ | 10 |
| Cobalt as $CoSO_4$ | 5 |
| Free $NH_3$ as $NH_4Cl$ | 30 |
| Urea | 90 |
| Boric acid | 20 |
| 3-pyridine carboxylic acid | 1 |
| NaOH | Adjust pH to 7.5 |

The aqueous, ammonia-based palladium alloy composition is deposited on the copper substrate using jet plating equipment as described in Example 5. The pH of the bath is maintained at 7.5 and the temperature is maintained at 60° C. The current density is 90 Amps/dm$^2$. The bath is expected to be stable during electroplating. The palladium/cobalt deposit is expected to be bright and crack-free.

EXAMPLE 8

The following aqueous, ammonia-based palladium/silver alloy composition is prepared for depositing a palladium/silver alloy on a copper substrate:

TABLE 6

| COMPONENT | AMOUNT (g/L) |
|---|---|
| Palladium as $[Pd(NH_3)_4]Cl_2$ | 10 |
| Silver as $Ag_2O$ | 5 |
| Free $NH_3$ as $NH_4Cl$ | 30 |
| Urea | 90 |
| Boric acid | 20 |
| 3-pyridine carboxylic acid | 1 |
| NaOH | Adjust pH to 7.5 |

The aqueous, ammonia-based palladium alloy composition is deposited on the copper substrate using jet plating equipment as described in Example 5. The pH of the bath is maintained at 7.5 and the temperature is maintained at 60° C. The current density is 90 Amps/dm$^2$. The bath is expected to be stable during electroplating. The palladium/silver deposit is expected to be bright and crack-free.

What is claimed is:

1. A method comprising:

a) providing a composition consisting of one or more sources of palladium ions, one or more sources of alloying metal ions, wherein the alloying metal ions are selected from the group consisting of nickel ions, cobalt ions, silver ions, zinc ions and iron ions, optionally one or more of alkali metal hydroxides and metal carbonates, optionally one or more buffers selected from the group consisting of sulfuric acid, hydrochloric acid, nitric acid, acetic acid, boric acid, carbonic acid, citric acid, tetraboric acid, maleic acid, itaconic acid and salts thereof, optionally one or more surfactants, one or more brighteners selected from the group consisting of succinimide, maleimide, quinolones, substituted quinolones, phenanthrolines and substituted phenanthrolines and quaternized derivitives thereof, pyridine carboxylic acids and pyridine carboxylic acid amines, ammonium ions, free ammonia in amounts of 10 g/L to 45 g/L and 80 g/L to 200 g/L of urea, water, and a pH of the composition is from 7 to 8;

b) contacting a substrate with the composition; and c) generating a current density of at least 10 Amps/dm$^2$ to deposit palladium alloy on the substrate.

2. The method of claim 1, wherein the current density ranges from 10 Amps/dm$^2$ to 100 Amps/dm$^2$.

* * * * *